US005286934A

United States Patent [19]

Bellino et al.

[11] Patent Number: 5,286,934

[45] Date of Patent: Feb. 15, 1994

[54] MOLDED CASE CIRCUIT BREAKER MOVABLE CONTACT ARM ARRANGEMENT

[75] Inventors: Jill C. Bellino; Joseph P. Bellino, both of W. Simsbury, Conn.

[73] Assignee: General Electric Company, New York, N.Y.

[21] Appl. No.: 764,287

[22] Filed: Sep. 23, 1991

[51] Int. Cl.[5] ..... H01H 33/02

[52] U.S. Cl. ..... 200/144 R; 200/147 R

[58] Field of Search ..... 200/144 R, 147 R, 244, 200/271, 275; 335/16, 189, 190, 192, 202

[56] References Cited

U.S. PATENT DOCUMENTS

| | | | |
|---|---|---|---|
| 3,970,975 | 7/1976 | Gryctko | 335/18 |
| 4,339,642 | 7/1982 | Seymour et al. | 200/153 G |
| 4,375,021 | 2/1983 | Pardini et al. | 200/147 |
| 4,583,065 | 4/1986 | Favre-Tissot | 335/106 |
| 4,733,033 | 3/1988 | Morris et al. | 200/153 |
| 4,733,211 | 3/1988 | Castonguay et al. | 335/192 |
| 4,736,174 | 4/1988 | Castonguay et al. | 335/167 |
| 4,757,294 | 7/1988 | Todaro et al. | 335/202 |
| 4,782,583 | 11/1988 | Castonguay et al. | 29/622 |
| 4,789,848 | 12/1988 | Castonguay et al. | 335/167 |
| 4,931,603 | 6/1990 | Castonguay et al. | 200/144 |
| 4,999,464 | 3/1991 | Bellino et al. | 200/267 |

*Primary Examiner*—Jeffrey A. Gaffin
*Assistant Examiner*—Michael A. Friedhofer
*Attorney, Agent, or Firm*—Richard A. Menelly

[57] ABSTRACT

A molded case circuit breaker movable contact arm electrically connects with the circuit breaker load terminal requiring only a small diameter auxiliary electrical braid conductor by pivotally arranging the contact arm within its support. The braid conductor is electrically connected with the movable contact arm by means of an off-set connector plate to provide strain relief to the braid conductor.

9 Claims, 3 Drawing Sheets

MOLDED CASE CIRCUIT BREAKER MOVABLE CONTACT ARM ARRANGEMENT

BACKGROUND OF THE INVENTION

When utilizing high speed current limiting circuit interruption to interrupt the circuit current in the early stages of the current waveform, it is important that the movable contact arm size to be as small as possible to promote electrodynamic repulsion. A further approach to improving the dynamics of contact arm repulsion is to eliminate the heavy flexible braid conductor that connects the contact arm to the load terminal.

U.S. Pat. No. 4,931,603 entitled "Molded Case Circuit Breaker Movable Contact Arm Arrangement" describes a "braidless" connection between the movable contact arm and its support which does not require any flexible braid conductor and which is of a small size to promote electrodynamic repulsion. This Patent should be reviewed for its detailed description of the movable contact arm support. When current limiting circuit interrupters are used within higher ampere-rated circuits, a small auxiliary flexible braid conductor is used to provide a parallel current path to deter pitting and such other corrosive electrical effects from occurring at the contact arm-contact support interface.

A further example of a braidless movable contact arm is found in U.S. Pat. No. 4,733,033. This Patent discloses the use of a spring having a planar configuration capable of holding the contact arm against its support posts with sufficient force to maintain electrical contact during overcurrent conditions. However, when this design is used within higher ampere-rated current limiting industrial circuit breakers, a parallel current path should be connected between the movable contact arm and the contact arm support posts to prevent the occurrence of arcing between the contact arm and the support posts under intense short-circuit overcurrent conditions.

The use of a smaller, lighter, flexible braid conductor to reduce the dynamic drag at the end of the movable contact arm, as described within U.S. Pat. No. 4,999,464, could cause wear on the end of the smaller, flexible braid under accelerated test conditions. This is believably due to the friction that occurs between the crossbar assembly that retains the movable contact arm and the end of the flexible braid that is directly welded or brazed to the end of the movable contact arm.

U.S. patent application Ser. No. 735,746 entitled "Molded Case Circuit Breaker Braid Conductor with Strain Relief" describes the interposition of a helical spring around the end of the braid conductor at the point of attachment to the movable contact arm in residential type lower ampere-rated circuit breakers.

U.S. Pat. No. 4,583,065 entitled "Electric Connection of Braids on a Circuit Breaker Terminal" describes an arrangement for attaching the opposite end of the braid conductor to the circuit breaker terminal supports.

One purpose of the invention is to describe an arrangement for attaching a smaller, lighter, flexible braid conductor to one end of a movable contact arm without causing the braid conductor to become frayed under sustained operation under accelerated test conditions.

SUMMARY OF THE INVENTION

A molded case circuit breaker movable contact arm is mechanically and electrically connected to a terminal support by means of a pair of support posts. An auxiliary braid conductor is connected between the contact arm and the terminal support to provide a parallel current path for higher ampere-rated operation. An off-set connector plate of malleable metal is first brazed or welded to the braid conductor and is then brazed or welded to one end of the movable contact arm. The malleable metal plate automatically positions the braid conductor away from the contact arm during the assembly process.

DESCRIPTION OF THE PREFERRED EMBODIMENT

Figure 1:
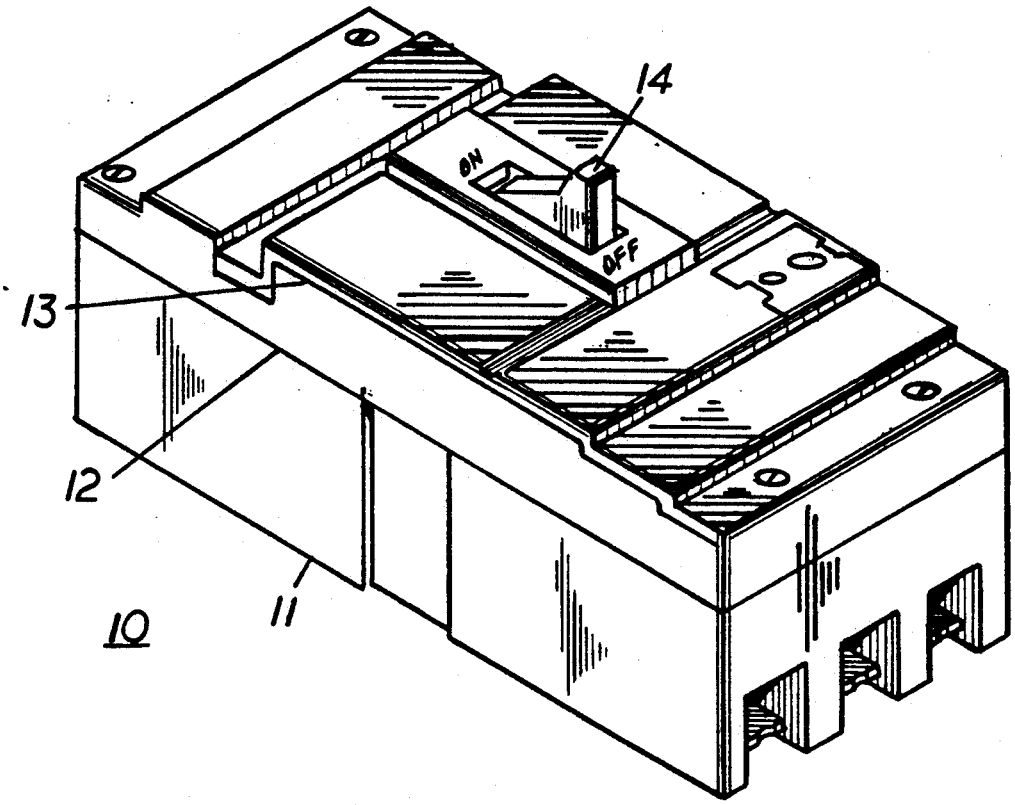
FIG. 1 is a top perspective view of a molded case circuit breaker including the contact arm arrangement in accordance with the invention.

A current limiting circuit breaker 10 is depicted in FIG. 1 and consists of a case 11 to which a cover 12 is attached and which further includes an accessory cover 13. A circuit breaker operating handle 14 extends through a slot formed within the circuit breaker cover for manual intervention to turn the circuit breaker to its ON and OFF conditions. As described in U.S. Pat. No. 4,757,294, an actuator unit (not shown) interfaces with an operating mechanism 15 by means of a trip bar 16 to separate the circuit breaker fixed and movable contacts 17, 18, best seen by referring now to FIG. 2.

Figure 2:
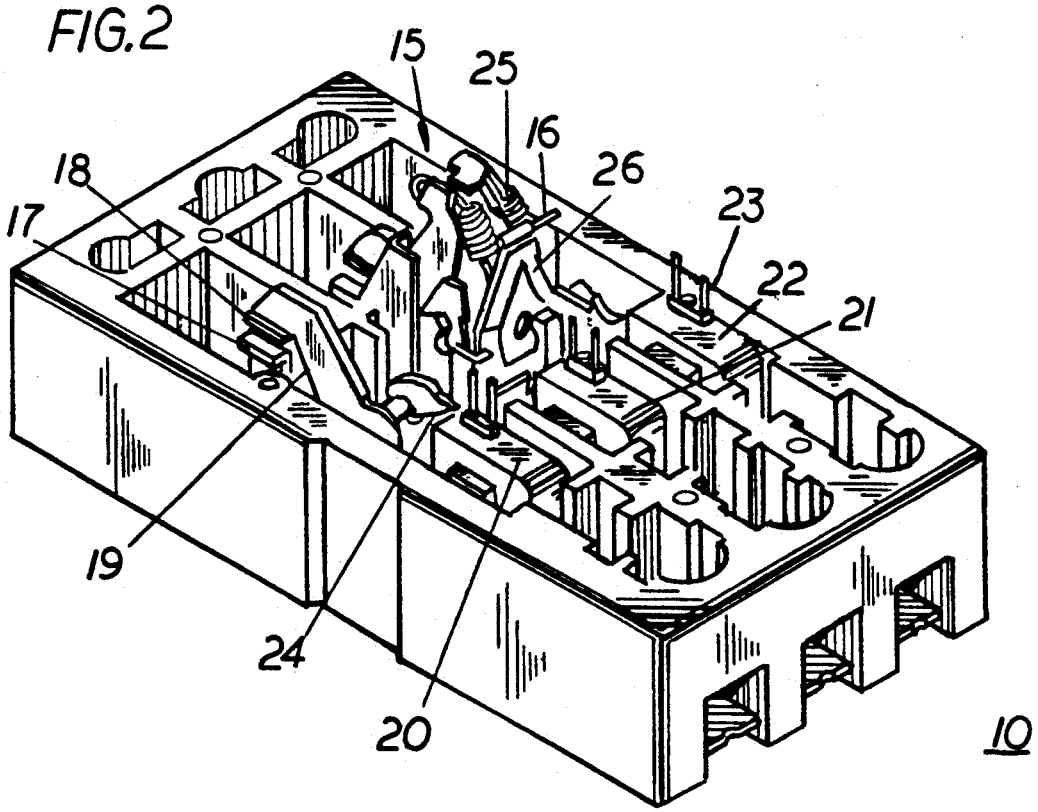
FIG. 2 is a top perspective view of the molded case circuit breaker of FIG. 1 with the cover removed to depict the circuit breaker operating mechanism arrangement.

The operating mechanism acts upon the movable contact arm 19 to drive the movable contact arm to the open position, shown in the circuit breaker 10 depicted in FIG. 2, upon the occurrence of overcurrent conditions of a predetermined magnitude. The circuit current is sensed by means of current transformers 20–22 which connect with the circuit breaker trip unit by means of upstanding pins as indicated at 23. A unitary crossbar arrangement 24, such as described in U.S. Pat. Nos. 4,733,211 and 4,782,583, insures that the movable contact arms operate in unison when the operating mechanism is articulated. The operating mechanism is held against the bias of a pair of powerful operating springs 25 by means of a latch assembly 26, such as described in U.S. Pat. Nos. 4,736,174 and 4,789,848. In order to provide the current limiting functions described earlier, the movable contact arms are adapted for independent movement from the crossbar assembly by electrodynamic repulsion acting on the movable contact arm itself. One such example of a current limiting circuit breaker is found within U.S. Pat. No. 4,375,021.

Figure 3:
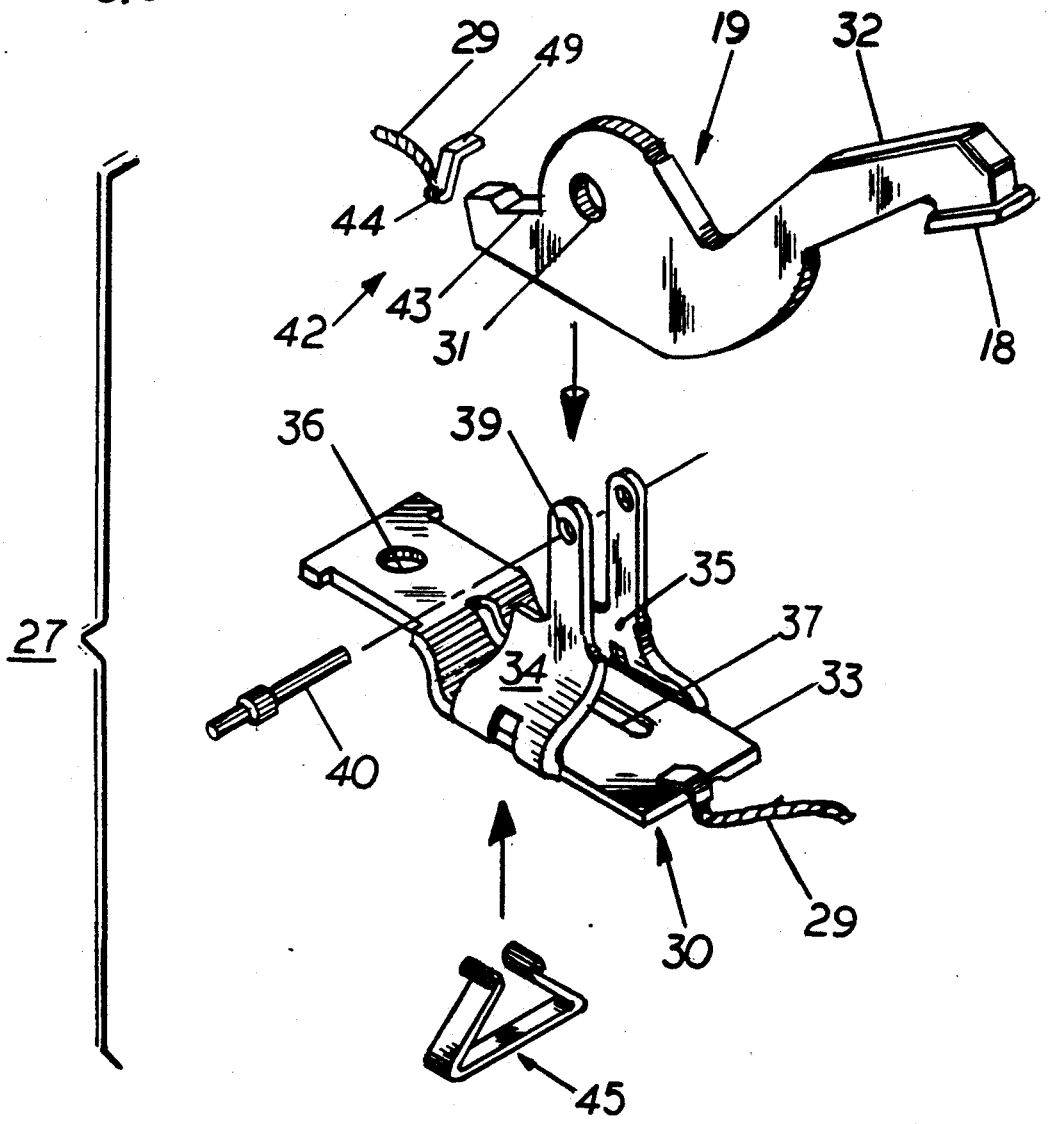
FIG. 3 is a top perspective view, in isometric projection, of the contact arm arrangement used within the circuit breaker depicted in FIG. 1.

When such intense overcurrent conditions occur, it is important that the movable contact arms maintain good electrical contact with the contact arm supports while the movable contacts move away from the fixed contacts. The movable contact assembly 27 shown in FIG. 3 improves over that described within aforementioned U.S. patent application Ser. No. 735,746. The movable contact arm 19 includes a central body part through which a thru-hole 31 is formed and an extended forward part 32 to the end of which the movable contact 18 is attached by welding or brazing. The movable contact arm is positioned within the circuit breaker case by means of a support base 33 which includes integrally-formed upstanding support arms 34, 35. The base is tempered in order for the support arms to resiliently capture the movable contact arm in a tight press-fit relation to promote good electrical conduction between the support arms and the movable contact arm. A thru-hole 36 formed within the support base allows for the electrical connection of the support base with the circuit breaker load strap (not shown). The provision of an elongated slot 37 within the support base intermediate the upstanding support arms allows for the flex of the support arms when the movable contact arm is inserted. When the movable contact arm is positioned within the support arms, the thru-hole 31 in the movable contact arm aligns with corresponding thru-holes 39 formed within the support arms. A pivot pin 40 is next inserted within the thru-holes 39 which are slightly oversized to permit rotation of the contact arm, and within thru-hole 31 in a press-fit relation. The clearance provided between the thru-holes 39 within the support arms and the ends of the pivot pin allows the movable contact arm to freely rotate within the support arms while maintaining good mechanical and electrical connection with the movable contact arm. It is important to maintain good electrical contact with the movable contact arm while the contact arm rotates between its closed and open position in order to deter local ionization and pitting between the contact arm and the pivot pin. A U-shaped contact spring 45 is next positioned over the support arms to further promote electrical connection between the support arms and the movable contact arm. Accordingly, the good electrical conduction between the contact arm, pivot pin and support arms insures that no localized arcing and pitting will occur. To further reduce arcing between the pivot pin 40 and the support arms 34, 35 a similar braid conductor 29 to that described within aforementioned U.S. Pat. No. 4,999,464 is connected between the contact arm support 30 and to the end of the movable contact arm 19 opposite from the movable contact 18. To prevent the braid conductor from becoming trapped beneath the underside of the crossbar 24 (FIG. 2) and the underlying surface of the movable contact arm and thereby becoming frayed upon repeated operation under accelerated test conditions, the braid conductor is off-set from the associated end of the movable contact arm by the provision of an off-set connector plate 42 a part of which is inserted within the planar slot 43 formed on the surface of the associated end of the contact arm. The off-set plate has an L-shaped configuration wherein the bottom leg 44 is welded or brazed directly onto the braid conductor 29 and the off-set top leg 49 is inserted within the planar slot 43 and welded or brazed thereto. The malleable copper is selected to deform slightly during the attaching process and to provide automatic positioning of the braid conductor away from the associated end of the moveable contact arm and hence away from the crossbar, described earlier.

Figure 4:
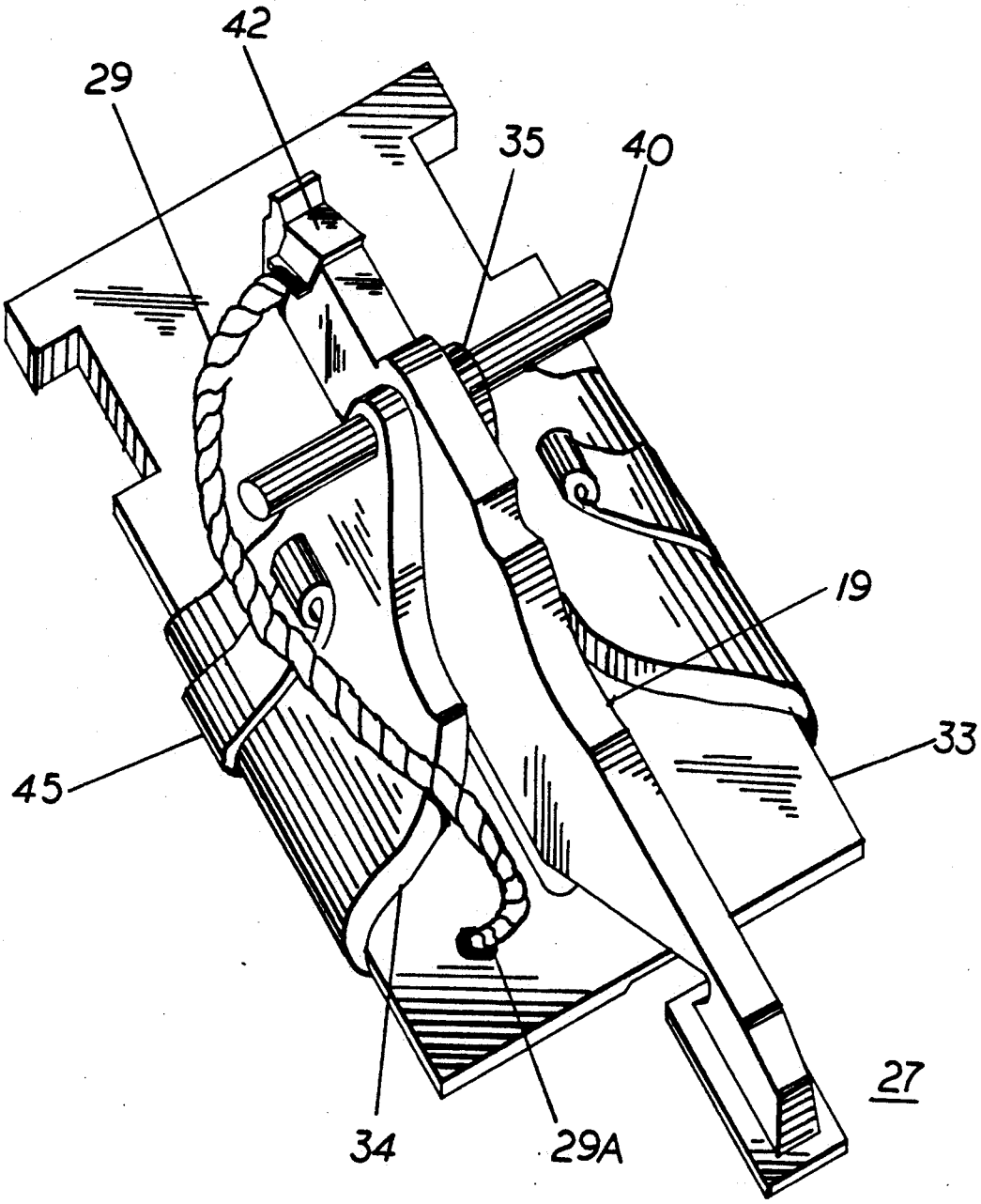
FIG. 4 is an enlarged top perspective view of the movable contact arm arrangement shown in FIG. 3.

The contact arm assembly 27 is depicted in FIG. 4 to show the arrangement of the moveable contact arm 19 on the support 33 with the pivot pin 40 arranged through the support arms 34, 35 and with the U-shaped contact spring 45 arranged over the support arms to insure good electrical conductivity between the support arms and the moveable contact arm. The electrical connection with one end of the braid conductor 29 and the support 33 is depicted at 29A and the electrical connection with the opposite end is depicted by means of the off-set connector plate 42. It can thus be seen that the connector plate effectively displaces the attached end of the braid conductor away from the end of the moveable contact arm to prevent fraying of the braid conductor over many cycles of operation.

Having thus described our invention, what we claim as new and desire to secure by Letters Patent is:

1. A molded case circuit breaker comprising:
a plastic case and cover;
an operating mechanism within said case arranged for driving a movable contact arm to an open position upon occurrence of an overcurrent condition of predetermined magnitude through an associated protected circuit;
a fixed and a movable contact arranged within said case, said movable contact being attached to one end of said movable contact arm;
a support base within said case having first and second ends, said movable contact arm being pivotally mounted on said base, said base being electrically-connected with said movable contact arm by a flexible braid conductor; and
said braid conductor being directly connected to said first end of said base and being connected with an opposite end of said movable contact arm through an off-set connector plate, said off-set plate comprising a malleable metal formed into an L-shaped configuration having a top leg and a bottom leg, said top leg being off-set from said bottom leg to thereby locate said attached braid conductor away from said opposite end.

2. The circuit breaker of claim 1 wherein said opposite end includes a planar slot formed on a surface of said opposite end.

3. The circuit breaker of claim 1 wherein said off-set plate is welded or brazed to said braid conductor.

4. The circuit breaker of claim 1 wherein said metal comprises copper.

5. The circuit breaker of claim 1 including a pair of support arms extending from said base, said contact arm being attached to said support arms by means of a pivot pin.

6. The circuit breaker of claim 5 including a U-shaped spring arranged on said support arms to bias said support arms against said contact arm.

7. The circuit breaker of claim 1 wherein said top leg is positioned within said planar slot.

8. A method of attaching a braid conductor to a molded case circuit breaker movable contact arm comprising the steps of:
providing a movable contact arm having a movable contact attached to one end;
arranging said contact arm on a base having first and second ends;
providing a flexible braid contact having first and second ends;
attaching said first end of said braid conductor to said first end of said support base;
attaching an off-set connector plate having an L-shaped configuration to said second end of said braid conductor; and
attaching said off-set connector plate having an L-shaped configuration to said second end of said contact arm.

9. The method of claim 8 including the steps of providing a rectangular slot in said second end of said contact arm; and
welding or brazing a top part of said off-set plate within said slot to thereby position said braid conductor away from said contact arm.

* * * * *